United States Patent [19]

Locher

[11] Patent Number: 4,790,598

[45] Date of Patent: Dec. 13, 1988

[54] INCLINABLE CHAIR PROVIDED WITH BALANCE OR ROCKER STRUCTURE

[75] Inventor: Hermann Locher, Dornach, Switzerland

[73] Assignee: Giroflex Entwicklungs AG, Koblenz, Switzerland

[21] Appl. No.: 106,455

[22] Filed: Oct. 9, 1987

[30] Foreign Application Priority Data

Oct. 14, 1986 [CH] Switzerland ..... 4124/86
Jul. 8, 1987 [CH] Switzerland ..... 2589/87

[51] Int. Cl.[4] ..... A47C 1/02

[52] U.S. Cl. ..... 297/325; 297/90; 297/273; 297/306; 297/344

[58] Field of Search ..... 297/91, 90, 273, 277, 297/278, 279, 325, 313, 330, 306, 344, 458

[56] References Cited

U.S. PATENT DOCUMENTS

| | | | |
|---|---|---|---|
| 2,615,497 | 10/1952 | Luckhardt | 297/61 X |
| 2,942,647 | 6/1960 | Pickles | 297/330 X |
| 3,765,720 | 10/1973 | Sakai | 297/330 |
| 4,307,914 | 12/1981 | Grandclement | 297/458 |
| 4,586,749 | 5/1986 | Nakatani | 297/90 X |
| 4,632,450 | 12/1986 | Holdt | 297/330 |

*Primary Examiner*—James T. McCall
*Attorney, Agent, or Firm*—Werner W. Kleeman

[57] ABSTRACT

The chair has a seat or seat portion equipped with a balance and its linkage structure has links fixed in articulated manner to a support arm and to which there is articulated a balance device in parallelogram-like manner. A slide is slidingly guided on the balance device and is connected by means of a thrust rod to an extension arm of the backrest-side link. The slide is also connected to one end of a spring element, the other end of which is supported on the balance device. The linkage structure is supported on the backrest by means of a backrest strut articulated to the slide. The seat and backrest portions of the chair frame can be constructed as a plastic shell with a knee-side bending joint and a further bending joint between the seat portion and the backrest portion. Due to the construction of the chair frame to incorporate a balance device, as least part of the forces exerted by the occupant or user of the chair can be absorbed by the balance device, so that the spring element can be made smaller and therefore less expensively, and there is also no need to adjust or adapt the spring element to different body weights of the users of the chair.

14 Claims, 3 Drawing Sheets

INCLINABLE CHAIR PROVIDED WITH BALANCE OR ROCKER STRUCTURE

BACKGROUND OF THE INVENTION

The present invention relates to a new and improved construction of a chair or the like, whose chair frame is equipped with a seat portion and a backrest portion and is supported on a support or carrier portion forming part of the chair pedestal or base and which support or carrier portion is provided with a projecting support arm.

Numerous different constructions of such type chairs are well known in this art. In order to increase sitting comfort, it is known to construct the seat portion so as to pivot or swivel with respect to the support or carrier portion or part, a spring element exerting an opposing force for supporting the body weight of the sitting person or occupant. If the seating comfort is to be further increased, particularly through the sitting person assuming a so-called relax or reclined position, it is also known to pivot the backrest portion with respect to the seat portion. Here again it is necessary to produce an opposing force by one or more correspondingly positioned spring elements to the forces exerted on the backrest portion by the chair occupant.

The forces exerted by the occupant on the seat portion and the backrest portion and which are transferred to the support or carrier portion or part are considerable. In the case of chairs with a pivotable seat portion and/or a pivotable backrest portion, it is necessary to support these two chair portions for ensuring the mobility thereof on a chair frame. The term chair frame is here understood to encompass components, elements or parts such as links or link elements or brackets, levers and spring elements, with the aid of which the seat portion and the backrest portion are supported on the support or carrier portion or part. However, as the chair frame must be accommodated in a minimum amount of space, as a result of the nature of the arrangement of these components, elements or parts, they must partially absorb much higher forces than merely that of the body weight of the chair occupant and, in particular, the spring elements must be designed to take-up quite considerable forces. They therefore have an unfavorable influence on the manufacturing costs.

SUMMARY OF THE INVENTION

Therefore with the foregoing in mind it is a primary object of the present invention to provide a new and improved construction of a chair which does not suffer from the aforementioned drawbacks and shortcomings of the prior art constructions.

Another and more specific object of the present invention is to provide a new and improved construction of a chair in which at least the seat portion is pivotably supported with respect to the support or carrier portion and wherein such type chair is designed such that the forces to be exerted by the spring element or elements are kept small and consequently smaller spring elements costing correspondingly less can be used.

A further significant object of the present invention is to keep small the volume of the chair frame located under the seat portion, which obviates the cumbersome or massive appearance of known chairs.

Still a further significant object of the present invention is directed to the provision of a new and improved construction of an inclinable or reclinable chair which is relatively simple in construction and design, quite economical to manufacture, highly reliable in operation, not readily subject to breakdown or malfunction, and requires a minimum of maintenance and servicing.

Yet a further noteworthy object of the present invention is directed to the provision of a new and improved construction of an inclinable or reclinable chair which possesses a highly compact construction, particularly of the mechanism beneath the seat portion which serves for selectively placing the chair from a normal work or upright position into a relax or reclined position and vice versa, so that the aesthetic appearance of the chair is considerably improved and there is imparted thereto a sleek and refined appearance.

Now in order to implement these and still further objects of the invention, which will become more readily apparent as the description proceeds, the inclinable or reclinable chair of the present development is manifested by the features that the link or link element pairs comprising links or link elements arranged at the knee-side and backrest-side or backrest region are pivotably articulated or hingedly connected to the support arm of the support or carrier portion and form a parallelogram suspension for a balance or rocker device, on which there are supported the seat portion and the backrest portion.

Due to the fact that the forces exerted on the seat portion and the backrest portion are at least partly compensated by the balance or rocker device, only part of the forces which occur have to be absorbed by the spring element or elements.

Stated in another way there is provided a chair including a knee-side or knee region and a backrest-side or backrest region. This chair comprises a seat portion and a backrest portion positioned to cooperate with or arranged adjacent to the seat portion. A support portion or part serves for supporting the seat portion and the backrest portion. This support portion preferably comprises a cantilevered support arm. There are also provided at least one pair of links comprising at least two link elements. One of these at least two link elements is arranged at the knee-side or knee region of the chair and the other one of such at least two link elements is arranged at the backrest-side or backrest region of the chair. A balance device cooperates with the at least two link elements. There are also provided means for pivotably connecting the at least two link elements to the cantilevered support arm such that there is provided a substantially parallelogram suspension for the balance device on which there are supported the seat portion and the backrest portion.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DESCRIPTION OF THE PREFERRED EMBODIMENTS

Figure 1:
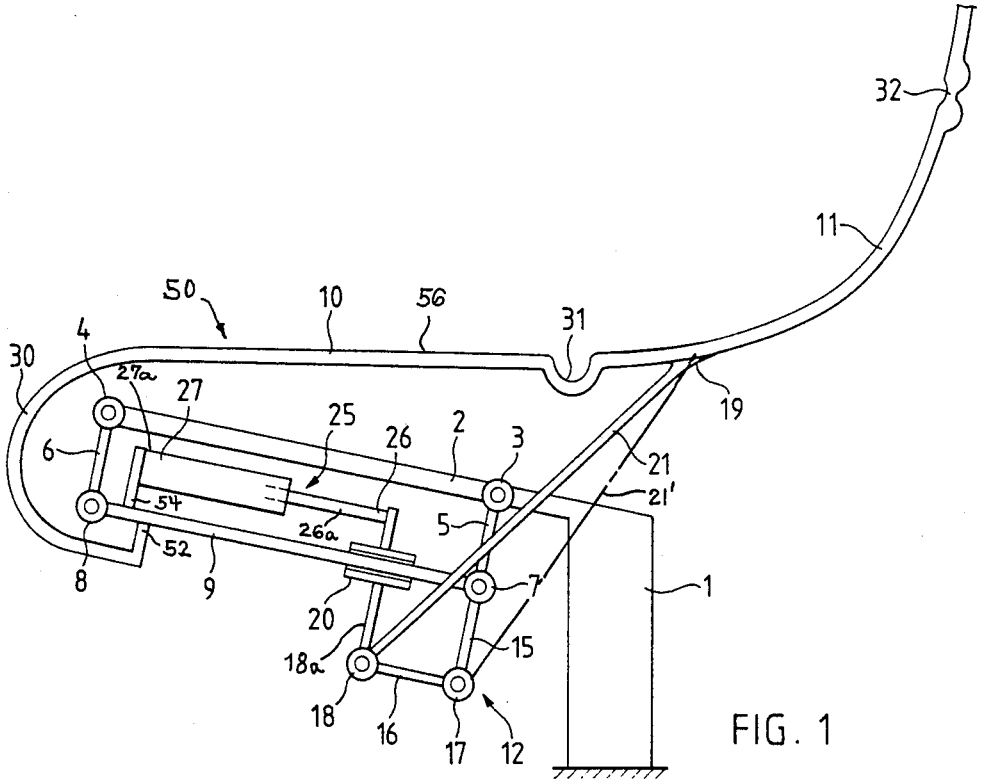
FIG. 1 shows the kinematic replacement diagram of an inventive chair, in which the backrest portion is not loaded and consequently the seat portion cannot be pivoted down rearwards or such that it slopingly reclines or inclines in rearward direction.

Describing now the drawings, it is to be understood that to simplify the showing thereof, only enough of the chair or the like has been illustrated therein as is needed to enable one skilled in the art to readily understand the underlying principles and concepts of this invention. Turning now specifically to FIG. 1 of the drawings, there will be recognized a support or carrier portion or part 1 of a not further shown suitable chair pedestal, to which is fixed a cantilevered support arm or member 2 which is inclined slightly with respect to a first predeterminate region, here the knee-side or knee region of the chair, generally indicated in its entirety by reference numeral 50. On the support arm 2, there are arranged two pivot joints 3 and 4 or the like, on which there is articulated a link or link element pair comprising the links or link elements 5 and 6 or equivalent structure which are pivotably connected by means of further pivot joints 7 and 8 or the like to a balance or rocker device 9.

The chair 50 has a seat portion or part 10 and a backrest portion or part 11 located at a second predeterminate region, here the backrest-side or backrest region of the chair 50. The seat portion or part 10 and the backrest portion or part 11 can be appropriately interconnected either rigidly or in articulated manner as will be discussed more fully below. The seat portion or part 10 is appropriately fixed at the location 52 to the balance or rocker device 9 in the vicinity of the knee-side or knee region link or link element 6. The backrest portion or part 11 is supported on the balance or rocker device 9 by means of a linkage structure or arrangement 12.

This linkage structure or arrangement 12 comprises several parts or components, namely an extension arm or extension 15 which forms part of the backrest-side or backrest region link or link element 5, a thrust or connecting rod 16, which is connected by means of a pivot joint 17 to the extension arm 15, a slide or slide member 20 to which there is articulated the thrust or connecting rod 16 by means of a pivot joint 18 and the link or link element 18*a* and which is displaceably guided as a sliding connection means on the balance or rocker device 9, and a backrest strut or bracket 21 which, on the one hand, is supported on the backrest portion 11 by means of a suitable fixed connection 19 and, on the other hand, is rotatably supported on the slide 20 by means of the pivot joint 18 or the like. However, it would also be possible to support the backrest strut 21 on the pivot joint 17 of the extension arm 15 as has been generally schematically indicated by the chain-dot line 21'.

On the balance or rocker device 9 there is mounted a spring element or spring means 25 or the like, one end 26 of which is connected at the backrest-side or backrest region end of the balance or rocker device 9 to the slide or slide member 20 and the other end 27 of which is suitably fixed at location 54 to the knee-side or knee region end of the balance or rocker device 9.

The spring element or spring means 25 can be a conventional compression spring or gas spring as is known in this art. In the case of a gas spring, the one end 26 constitutes a piston rod 26*a* supported on the slide or slide member 20 and the other end 27 constitutes a cylinder 27*a* fixed at location 54 to the balance or rocker device. As the spring element 25 is only displaced substantially parallel to the balance or rocker device 9, the ends 26, 27 can be fixed to such balance or rocker device 9.

Figure 2:
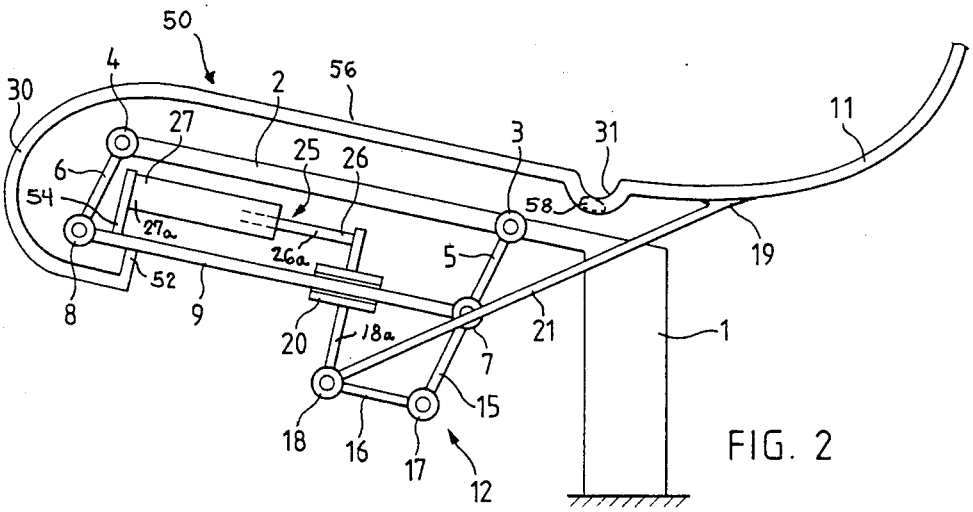
FIG. 2 is a kinematic replacement diagram of the chair according to FIG. 1, in which the backrest portion is loaded and consequently the seat portion is pivoted down rearwards (so-called relax or reclined position)

FIG. 2 shows the so-called relax or reclined position of the chair 50. By virtue of the force exerted by the backrest portion 11, via the backrest strut 21 on the slide 20, the latter is moved in the direction of the knee-side or knee region of the chair 50 on the balance or rocker device 9 against the force of the spring element 25. Simultaneously the links or link elements 5 and 6 of the link or link element pair 5,6 are pivoted against the knee-side or knee region of the chair 50. The balance or rocking device 9, which is also articulated by the pivot joints 7 and 8 to the links or link elements 5 and 6 is also moved in the direction of the knee-side or knee region of the chair 50, but its travel is smaller, because the slide or slide member 20 is moved by the extension arm or arm member 15. The difference between these two movement paths is the path by which the spring element 25 or the like is compressed and consequently exerts an opposing or counter force. It can be readily gathered from FIGS. 1 and 2, that the weight of a person sitting on the chair does not have to be entirely absorbed by the spring element 25 and can be at least partly compensated or balanced by the pivoting movement of the links or link elements 5 and 6 and the balance or rocker device 9. As a result, the spring element 25 can be advantageously made correspondingly smaller.

The actual construction of the seat portion 10 and the backrest portion 11 is unimportant for the function of the balancing or compensating action of the parallelogram-like suspended balance or rocker device 9. In FIGS. 1 and 2, the two char portions or parts 10 and 11 ar constituted by a single, fiber-reinforced plastic shell 56 which is provided on the knee-side or knee region with a ending joint or bending portion 30 which can, for example, be provided with a progressively increasing spring force or characteristic. The fiber-reinforced plastic shell 56 can be formed, for instance, of a suitable polyester resin reinforced with glass fibers or carbon fibers. A further bending joint or bending portion 31 is provided between the seat portion 10 and the backrest portion 11 and its spring characteristic can also be correspondingly chosen. If necessary, the bending joint 31 or equivalent structure can be provided with more than one bend. A further bending joint 32 can be provided in the backrest portion 11. As a result of the construction of these bending joints, the chair can be constructed with a random or optionally desired pivoting characteristic.

In place of the plastic shell 56, other constructions can be combined with the described linkage structure or arrangement 12. Thus, the plastic shell 56 can be replaced by a metal shell structure, or it is possible to use seat portions and backrest portions provided with joints or hinge structures. In this case, the knee-side or knee region bending joint or portion 30 can be replaced by a pivot or rotary joint, for example, by a conventional torsion spring element, as can also the bending joint 31 located at the backrest-side or backrest region of the chair 50. Such a torsion spring element has been schematically represented in FIG. 2 by reference character 58. In place of the torsion spring, it is also possible to use other springs, but this can lead to space problems.

Figure 3:
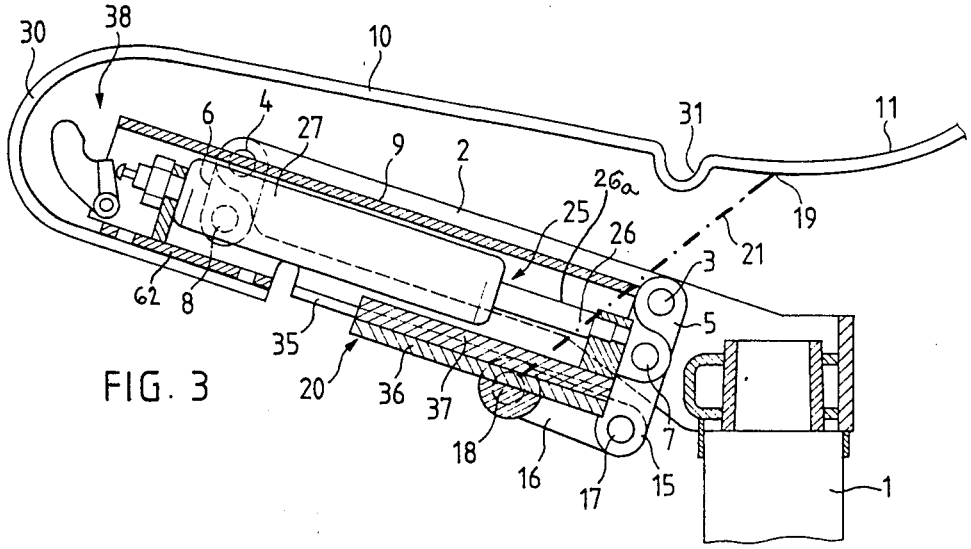
FIG. 3 is a schematic representation of a vertical partial sectional view through a construction of the chair according to the kinematic replacement diagram of FIGS. 1 and 2.
Figure 4:
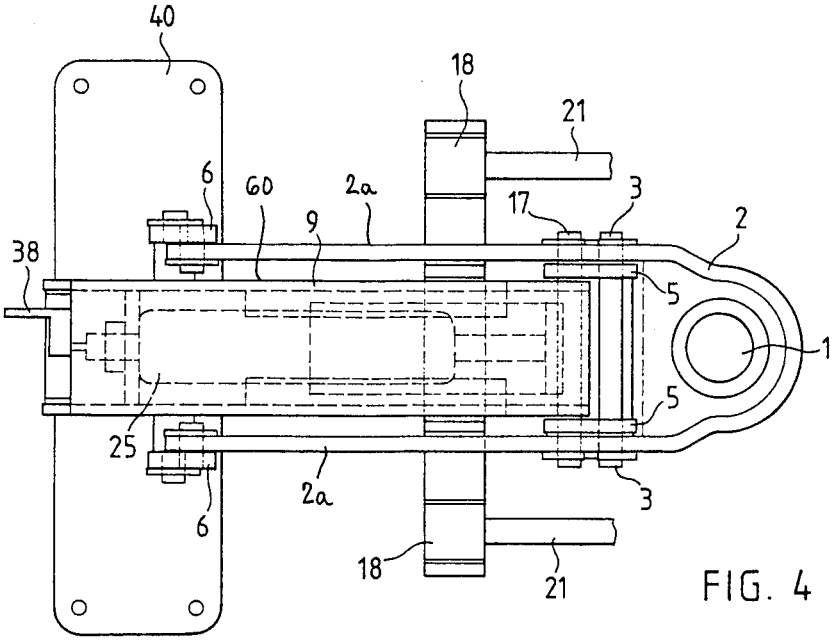
FIG. 4 is a top plan view of the chair according to FIG. 3 with the removed seat portion and backrest portion to enhance the clarity of illustration.

FIGS. 3 and 4 show an embodiment of the heretofore described chair 50. As noted previously like reference numerals generally have the same significance as in the arrangement of FIGS. 1 and 2 and are not therefore explained again. It can be seen from FIG. 4 that the support arm or member 2 of the support or carrier portion 1 is constructed as a double-arm structure 2*a*. Therefore, there are two link or link element pairs 5,6 containing the heretofore described links or link elements 5 and 6. Between the individual arms or parts 2*a* of the support arm or member 2, the balance or rocker device 9 is constructed in the form of a hollow cylinder 60, for example, a square or four-edged tube 62. It is provided on its underside with a slot 35 in which the slide or slide member 20 comprising plates 36 and 37 or the like is held together by means of a suitable and thus not particularly shown connecting bolt or equivalent structure. Piston rod 26*a* is fixed to the slide or slide-member 20 and the cylinder 27*a* of the spring element 25 is fixed to the knee-side or knee region end of the balance or rocker device 9. A suitable and known operating mechanism 38 releases or blocks the spring element 25. It can be seen from FIG. 4 that two backrest struts 21 are articulated or hinged to the pivot joints or pivot joint means 18. A fastening plate 40 is provided on the knee-side or knee region or fixing the chair portions or parts 10 and 11 constructed as a plastic shell 56.

In the further embodiment shown in FIGS. 5 and 6, again the same reference numerals have been generally used to indicate the same or analogous components as employed for the chair embodiment first described with reference to FIGS. 1 to 4.

In order to reduce the precision requirements for the manufacture of the parallelogram suspension, while still ensuring that such parallelogram suspension can function in clearance-free and jamming-free manner, here a further or second parallelogram suspension is provided. For this purpose, link or link element 6 is constructed in the same way as link or link element 5 so as to now contain an extension arm or extension 34. A pivot joint 28 is provided on the free end 34*a* of extension arm 34. This pivot joint 28 and pivot joint 17 of the extension arm 15 are connected with a connecting link or link element 33. The extension arms 15 and 34 together with the connecting link or link element 33 consequently form, with respect to the balance or rocker device 9, a further or second parallelogram arrangement which is disposed substantially parallel to the initially or first considered parallelogram arrangement composed of the links or link elements 5 and 6 and the balance or rocker device 9.

Figure 5:
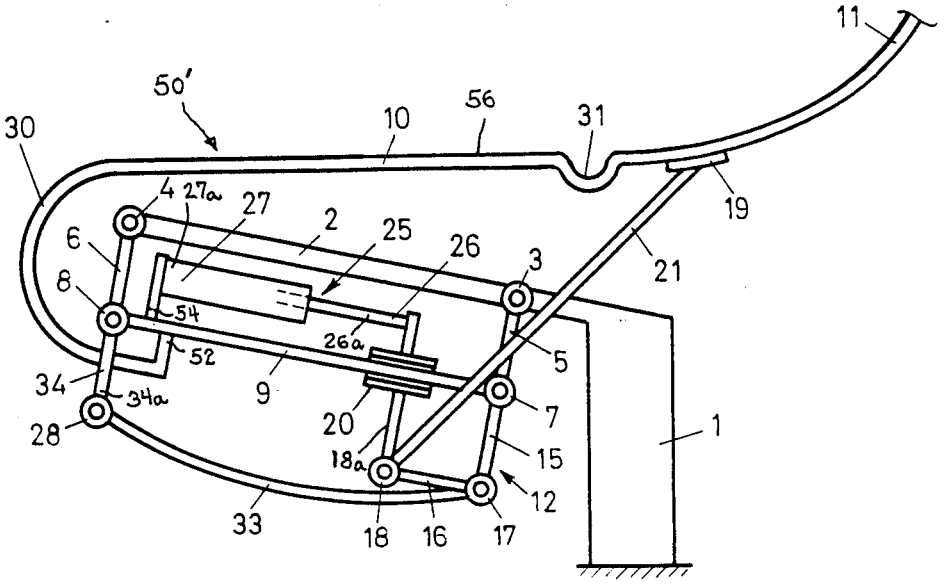
FIG. 5 is a kinematic replacement diagram of a further embodiment of inventive chair with an inclinable seat portion in the working position, i.e. with the backrest portion not pivoted down rearwards.
Figure 6:
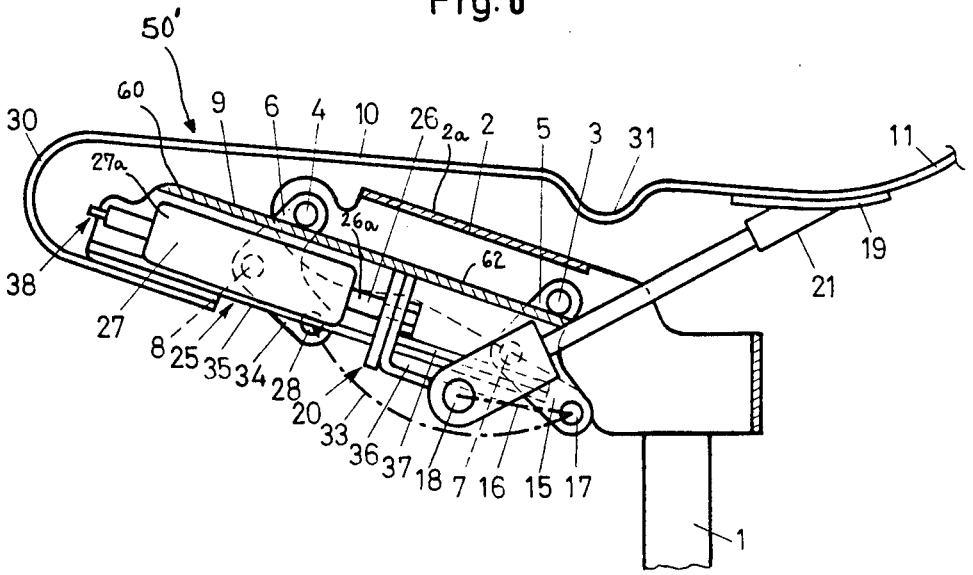
FIG. 6 is a schematic representation of a vertical partially sectional view through the further embodiment of chair constructed according to the kinematic replacement diagram of FIG. 5.

FIG. 6 shows a practical space-saving embodiment of the chair frame of the chair 50' described with reference to FIG. 5. Again like reference numerals have the same meanings as in FIG. 5, so that they will only be explained to the extent necessary for the understanding of the function of this embodiment of chair 50'. The support arm 2 of the support or carrier portion 1 is constructed as a double-arm structure 2*a*. Correspondingly, there are two link or link element pairs containing the links or link elements 5 and 6. Between the arms or parts of the double-arm structure 2*a* of the support arm 2, the balance or rocker device 9 is constructed in the form of a hollow cylinder 60, for example, a square or four-cornered tube 62. The latter is provided on its underside with a slot 35, in which the slide 20 comprising plates 36 and 37 is held together by a not shown connecting bolt or equivalent structure. The piston rod 26*a* is fixed to the slide or slide member 20 and the cylinder 27*a* of the spring element 25 is fixed to the knee-side or knee region end of the balance or rocker device 9. Again a suitable operating mechanism 38 is used for releasing or blocking the spring element 18.

The links or link elements 5 and 6 with their extension arms or extensions 15 and 34 form two-armed or double-armed levers, whose bearing points located between the arms form the pivot joints 7 and 8 connected to the balance or rocker device 9.

The connecting link or link element 33 connected by means of the pivot joints 17 and 28 to the two-armed levers 5, 15 and 6, 34 is shown in chain-dot or dot-dash line form in FIG. 6, in order to make the latter easier to understand. The connecting link or link element 33 is appropriately oppositely curved, i.e. concavely against or with respect to the seat portion 10. The connecting link or link element 33 can be punched from a strip material and provided at either end with a suitable bore. It is also important that the two-armed levers 5, 15 and 6, 34 are constructed as angle levers, as shown in FIG. 6.

Despite the shape differences of the two-armed levers 5, 15 and 6, 34 as angle levers and as used in the embodiment of chair depicted in FIG. 6 and the connecting link or link element 33 directed concavely with respect to the seat portion 10, the function of the balance is the same as that of the previously described chair 50 considered with reference to FIGS. 1 to 4.

The described chair frame has the advantage that part of the forces exerted by a sitting person or chair occupant are compensated by a balance or balance structure which is formed by the link or link element pairs 5, 6 and the balance or rocker device 9. As a result the spring element 25 can be beneficially made smaller, so that it can be housed or accommodated in the balance or rocker device 9. As a result of this compensation of the forces, there is no need to adjust the spring element 25 with respect to the weight of the chair occupant. If a person sits on the chair without leaning back, virtually the entire weight is balanced or compensated by such balance structure. Only on passing into the relax or reclined position is part of the occupant's weight taken up by spring element 25.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A chair including a knee region and a backrest region, comprising:

a seat portion;

a backrest portion positioned to cooperate with said seat portion;

a support portion for supporting said seat portion and said backrest portion;

said support portion including a cantilevered support arm;

at least one pair of links comprising at least two link elements;

one of said at least two link elements being arranged at the knee region of the chair;

the other one of said at least two link elements being arranged at the backrest region of the chair;

a balance device cooperating with said at least two link elements;

means for pivotably connecting said at least two link elements to said cantilevered support arm such that there is provided a substantially parallelogram suspension for said balance device on which there are supported the seat portion and the backrest portion;

said link element which is arranged at said backrest region of the chair comprises an extension arm having an end;

a thrust rod;

means for connecting said end of said extension arm to said thrust rod;

a slide;

means for operatively connecting said thrust rod with said slide;

spring means having opposite ends;

said balance device including a knee region end;

one end of said spring means being supported at said slide; and the other end of said spring means being supported at said knee region end of said balance device.

2. The chair as defined in claim 1, wherein:

said balance device has a knee region end and a backrest region end;

said seat portion being positioned at the region of the knee region end of the balance device; and said backrest portion being positioned at the region of the backrest region end of the balance device.

3. The chair as defined in claim 1, further including:

a backrest strut supported at said backrest portion; and means for articulating said backrest strut to said extension arm.

4. The chair as defined in claim 1, further including:

a backrest strut supported at said backrest portion; and means for articulating said backrest strut in operative association with said slide.

5. The chair as defined in claim I, wherein said slide is structured as a sliding connection means which is guided along the balance device.

6. A chair including a knee region and a backrest region, comprising:

a seat portion;

a backrest portion positioned to cooperate with said seat portion;

a support portion for supporting said seat portion and said backrest portion;

said support portion including a cantilevered support arm;

at least one pair of links comprising at least two link elements;

one of said at least two link elements being arranged at the knee region of the chair;

the other one of said at least two link elements being arranged at the backrest region of the chair;

a balance device cooperating with said at least two link elements;

means for pivotably connecting said at least two link elements to said cantilevered support arm such that there is provided a substantially parallelogram suspension for said balance device on which there are supported the seat portion and the backrest portion; and said seat portion and said backrest portion are molded as a single fiber-reinforced plastic shell.

7. The chair as defined in claim 6, wherein:

said single fiber-reinforced plastic shell comprises a polyester resin reinforced with glass fibers.

8. The chair as defined in claim 6, wherein:

said single fiber-reinforced plastic shell comprises a polyester resin reinforced with carbon fibers.

9. The chair as defined in claim 6, wherein:

said plastic shell is constructed on the knee region of the chair as a bending joint possessing a spring characteristic having a progressively increasing torsion;

a backrest strut fixedly connected to said backrest portion; and a further bending joint provided between the seat portion and the backrest portion and in the vicinity of which the backrest strut is fixedly connected to the backrest portion.

10. The chair as defined in claim 1, wherein:

each of the at least two link elements respectively arranged at the backrest region of the chair and the knee region of the chair are constructed as two-armed levers;

each of said two-armed levers contain a first arm and a second arm;

said first arms of said two-armed levers of said at least two link elements connecting the balance device with the cantilevered support arm in a substantially parallelogram arrangement defining said substantially parallelogram suspension;

a connecting link positioned between said at least two link elements; and said second arms of said two-armed levers of said at least two link elements connecting said connecting link with said balance device and thereby forming a further parallelogram arrangement.

11. The chair as defined in claim 10, wherein:

said two-armed levers are constructed as angle levers;

means defining bearing points for said angle levers;

said bearing points being respectively located between the first and second arms of said two-armed levers; and said bearing points being pivotably connected to said balance device.

12. A chair including a knee region and a backrest region, comprising:

a seat portion;

a backrest portion positioned to cooperate with said seat portion;

a support portion for supporting said seat portion and said backrest portion;

said support portion including a cantilevered support arm;

at least one pair of links comprising at least two link elements;

one of said at least two link elements being arranged at the knee region of the chair;

the other one of said at least two link elements being arranged at the backrest region of the chair;

a balance device cooperating with said at least two link elements;

means for pivotable connecting said at least two link elements to said cantilevered support arm such that there is provided a substantially parallelogram suspension for said balance device on which there are supported the seat portion and the backrest portion;

each of the at least two link elements respectively arranged at the backrest region of the chair and the knee region of the chair are constructed as two-armed levers;

each of said two-armed levers contain a first arm and a second arm;

said first arms of said two-armed levers of said at least two link elements connecting the balance device with the cantilevered support arm in a substantially parallelogram arrangement defining said substantially parallelogram suspension;

a connecting link positioned between said at least two link elements;

said second arms of said two-armed levers of said at least two link elements connecting said connecting link with said balance device and thereby forming a further parallelogram arrangement; and the connecting link having a non-linear shape.

13. The chair as defined in claim 12, wherein:

said connecting length has a curved shape.

14. The chair as defined in claim 12, wherein:

said connecting link has a substantially concave shape directed towards the seat portion.

* * * * *